US007206539B2

(12) United States Patent
Kawahara et al.

(10) Patent No.: US 7,206,539 B2
(45) Date of Patent: Apr. 17, 2007

(54) NON-MAGNETIC SINGLE COMPONENT DEVELOPING DEVICE

(75) Inventors: Akihiko Kawahara, Nara (JP); Tadayuki Sawai, Nara (JP); Kazuya Korematu, Nara (JP); Toru Nishikawa, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 51 days.

(21) Appl. No.: 11/079,883

(22) Filed: Mar. 15, 2005

(65) Prior Publication Data

US 2005/0220499 A1 Oct. 6, 2005

(30) Foreign Application Priority Data

Mar. 15, 2004 (JP) ..... P2004-073192

(51) Int. Cl.
*G03G 15/08* (2006.01)

(52) U.S. Cl. ..... 399/281

(58) Field of Classification Search ..... 399/252, 399/272, 281
See application file for complete search history.

(56) References Cited

U.S. PATENT DOCUMENTS 5,287,150 A 2/1994 Kinoshita et al.
5,311,264 A 5/1994 Kinoshita
5,573,994 A * 11/1996 Kabra et al. ..... 502/402
5,998,080 A * 12/1999 Ohno et al. ..... 430/108.4
6,810,227 B2 * 10/2004 Sakata et al. ..... 399/281
2001/0003757 A1 * 6/2001 Sakata et al. ..... 521/137
2003/0113139 A1 * 6/2003 Yasukawa et al. ..... 399/281

FOREIGN PATENT DOCUMENTS

JP 5-181352 7/1993
JP 5-273848 10/1993
JP 3182063 7/2001
JP 2003-255691 9/2003

* cited by examiner

*Primary Examiner*—Sandra L. Brase
(74) *Attorney, Agent, or Firm*—Nixon & Vanderhye P.C.

(57) ABSTRACT

A non-magnetic single component developing device that is included in combination with a photoreceptor in an image forming apparatus 1 of the electro-photographic system. The non-magnetic single component developing device includes a developing roller, a supplying roller, a doctor, a toner bath and a stirring blade. The supplying roller contains a rubber foam at least in its surface layer portion, the rubber foam including closed cells and open cells and having a foam ratio (porosity) of 0.75 to 0.85 and an average foam cell diameter of 350 to 500 μm.

9 Claims, 2 Drawing Sheets

NON-MAGNETIC SINGLE COMPONENT DEVELOPING DEVICE

BACKGROUND OF THE INVENTION

1. Field of the Invention

The present invention relates to a non-magnetic single component developing device.

2. Description of the Related Art

The electro-photographic system easily can form images with good image quality and therefore can be used in a wide range of image forming apparatuses such as copiers, printers and facsimiles. The process for forming images using the electro-photographic system includes a charging process in which a photosensitive surface containing a photoconductive substance is uniformly charged, an exposing process in which the photosensitive surface is exposed so that an electrostatic latent image is formed, a developing process in which a developing agent is attached to the electrostatic latent image on the photosensitive surface so that a toner image made of toner contained in the developing agent is formed, a transfer process in which the toner image carried on the photosensitive surface is transferred to a surface of a recording medium such as a paper sheet, and a fixing process in which the toner image is fixed onto the paper sheet by, for example, heating and pressing.

In the developing process, the developing agent is temporarily attached to a developing roller, and this developing agent is supplied to the electrostatic latent image on the photosensitive surface, so that the electrostatic latent image is developed and thus a toner image is formed.

In an image forming apparatus, a portion that performs the developing process is generally referred to as a "developing device". Although various forms of developing devices are known, non-magnetic single component developing devices, which use only non-magnetic toner as the developing agent, are becoming the main stream. FIG. 2 is a side view schematically showing the structure of a non-magnetic single component device. A developing device 100 includes a developing roller 101, a development bias application power source s2, a supplying roller 102, a regulating blade 103 and a toner container 105. The developing roller 101 is in contact with a photoreceptor 106 in a nip portion (developing portion) 107 and is provided so as to rotate in the direction of an arrow B, that is, in the counterclockwise direction. The development bias applying power source S2 applies a voltage to the developing roller 101. The supplying roller 102 is in contact with the developing roller 101 and provided so as to rotate in the direction of an arrow D, that is, in the counterclockwise direction, to supply a toner 104 to the developing roller 101. The regulating blade 103 is in contact with the developing roller 101 in a portion on the downstream side in the rotation direction of the developing roller 101 from a contact portion 108 where the developing roller 101 is in contact with the supplying roller 102 and forms a toner thin layer on the developing roller 101. The toner container 105 stores the toner 104.

With the developing device 100, first, the toner 104 in the toner container 105 is charged with electricity by friction in the contact portion 108 of the developing roller 101 and the supplying roller 102, and the toner 104 charged with electricity is attached to the surface of the developing roller 101 to which a voltage is applied by the development bias applying power source S2. The toner 104 on the surface of the developing roller 101 is shaped into a thin layer having a uniform thickness while its thickness is adjusted by the regulating blade 103. The thin layer of the toner 104 on the developing roller 101 is conveyed to the nip portion 107 by the continuous rotation of the developing roller 101, and supplied to the electrostatic latent image on the photoreceptor 106, and thus the electrostatic later image is developed. The toner 104 that remains on the developing roller 101 without having been supplied for development of the electrostatic latent image is conveyed back to the toner container 105 by the continuous rotation of the developing roller 101, scratched and collected from the developing roller 101 by the supplying roller 102 in the contact portion 108, and new toner 104 is supplied by the supplying roller 102 onto the developing roller 101 from which the toner 104 has been scratched and collected. Such a function-operation cycle is repeated.

In the image forming apparatus of the electro-photographic system, using the non-magnetic single component developing device advantageously makes it possible to facilitate the maintenance, and reduce the size, the weight and the cost. However, the non-magnetic single component developing device has drawbacks stemming from the material of the supplying roller. More specifically, in general, the supplying roller is formed of foam such as a closed cell foam having closed cells, and an open cell foam having open cells in order to carry toner. However, the supplying roller formed of a signal cell type foam has a very high surface hardness, the pressure by the contact with the developing roller is increased, which increases its driving torque, and thus toner filming on the developing roller, toner degradation, abrasion more than necessary of the supplying roller, and the like can occur easily. In addition, the supplying roller formed of a signal cell type foam can carry toner in an only small amount, so that the amount of toner supplied to the developing roller is decreased, and therefore, defective printing such as blur occurs in the printed images. On the other hand, the supplying roller formed of an open cell foam, in which foam cells are linked continuously, has a relatively low surface hardness, and carries toner in a large amount. Therefore, the performance of supplying toner to the developing roller is good. However, when used continuously for a long time, a large amount of toner, enter inside the open cells and remain there, so that the supplying roller becomes hard, and thus the surface hardness is significantly increased consequently, similarly to the supplying roller formed of a closed cell foam, increase in the driving torque, abrasion in the hardened portion or the like occurs. Furthermore, toner filming on to the developing roller, toner degradation or the like occurs easily. In general, the supplying roller is formed by coating a circumferential surface of a core metal with a foam layer, and when an open cell foam is used for the foam layer, the foam layer is peeled from the core metal in use, because its mechanical strength is insufficient.

On the other hand, in the supplying roller formed of a foam having a large cell diameter, the walls between adjacent cells on the surface of the supplying roller are split as the driving time passes, and thus the number of cells that can temporarily carry toner is decreased. Therefore, the performance of supplying toner to the developing roller deteriorates, the consistency of solid images deteriorates, and solid images are blurred. Furthermore, in the supplying roller formed of a foam having a small cell-diameter, in general, the surface hardness is high, so that the toner filming to the developing loner, toner degradation, abrasion of the supplying roller and the like can occur easily In view of such a problem, a supplying roller formed of a single cell type rubber foam having a density of 0.18 to 0.28 g/cm$^3$ has been proposed (e.g., JP5-273848A). However, this supplying roller has slightly better surface hardness and performance of supplying toner to the developing roller than the conventional supplying roller formed of a closed cell foam, but its level is not sufficiently satisfactory. Therefore, an increase of the driving torque by continuous use, toner degradation, deterioration of the consistency solid images, and the like cannot be prevented. Furthermore, the durability, in particular, the long term abrasion resistance of this supplying roller is insufficient, and its surface is easily worn away by the friction with, for example, the developing roller, the regulating blade. More specifically, the walls between adjacent cells are split on the surface of the supplying roller, so that the rubber foam is scraped and thus the outer diameter of the supplying roller is reduced from the original size. Consequently, insufficient scratching of toner with the developing roller, a decrease of the charge amount of toner due to insufficient contact, deterioration of the consistency with the developing roller and the like occur. Therefore, defective printing such as blur cannot be prevented. In particular, in heavily printed images such as solid images, printing blur is significant after toner is consumed corresponding to one circumference of the developing roller and one circumference of the supplying roller, more specifically, images in the second half in the printing direction are significantly blurred.

Furthermore, a supplying roller in which a layer made of an open cell foam having a low compressive elasticity and a low hardness is formed on a core metal, and a layer made of a closed cell foam is formed on that layer has been proposed (e.g., JP5-181352A). However, also in this supplying roller, the drawbacks of the supplying roller having a closed cell foam as the surface layer are not sufficiently solved. In particular, the performance of supplying toner to the developing roller is insufficient, so that defective printing such as blur due to long term continuous use may occur easily. Furthermore, for production of the supplying roller, in general, the foaming process for forming a foam layer twice and the abrading process for shaping the foam layer to a desired for twice are necessary, which significantly increases the production cost. Therefore, this is not industrially suitable.

A supplying roller made of a rubber material having a structure in which crosslinking is effected with a plasticizer is used. In this supplying roller, friction and friction heat caused by the contact with the developing roller cause the plasticizer to be oozed from the rubber material so that the crosslinking structure is dismantled, so that the elasticity of the rubber material tends to disappear. As a result, the surface hardness of the supplying roller is increased significantly, and thus the disadvantages as described above are caused.

Furthermore, in an image forming apparatus such as copiers, there is a demand for further increase in the number of sheets that can be oriented with one filling of toner (guaranteed number of sheets), and for this, it is very important to, for example, improve various characteristics of the supplying roller and increase the life of the supplying roller

SUMMARY OF THE INVENTION

An object of the invention is to provide a non-magnetic single component developing device that includes a supplying roller in which the surface hardness is prevented from increasing even after a long term and continuous use, increase of the driving torque, toner degradation and the like do not occur, the amount of toner supplied to a developing roller is maintained in a suitable range, defective printing such as blur does not occur, and the life can be increased, and that can form recording images with high image quality over a long time.

The invention provides a non magnetic single component developing device comprising:

a developing roller that is in contact with a surface of a photoreceptor and supplies toner to an electrostatic latent image on the surface of the photoreceptor;

a regulating blade that is in contact with a circumferential surface of the developing roller and forms a toner-thin film on the circumferential surface of the developing roller; and a supplying roller that is in contact with the circumferential surface of the developing roller and supplies toner to the circumferential surface of the developing roller, in which the toner formed into a thin film by the regulating blade in the circumferential surface of the developing roller is supplied to the surface of the photoreceptor that is contact with the circumferential surface of the developing roller to turn the electrostatic latent image into a toner image, wherein the supplying roller contains a rubber foam at least in its surface layer portion, the rubber foam including closed cells and open cells and having a foam ratio (porosity) of 0.75 to 0.85 (0.75 or more and 0.85 or less) and an average foam cell diameter of 300 to 500 μm (300 μm or more and 500 μm or less).

In the invention it is preferable that in the rubber foam, the pore diameter of an opening portion formed in the foam cell film between adjacent foam cells of the open cells is 300 μm or less.

Furthermore, in the invention it is preferable that the pore diameter of the opening portion is 200 μm or less.

Furthermore, in the invention it is preferable that the rubber loam does not contain a plasticizer.

Furthermore, in the invention it is preferable that the rubber foam is an ethylene propylene rubber foam that does not contain a plasticizer.

In the invention it is preferable that the rubber foam has a density of 0.14 to 0.30 g/cm$^3$ (0.14 g/cm$^3$ or more and 0.30 g/cm$^3$ or less).

In the invention it is preferable that the rubber foam has a tensile strength of 0.2 MPa or more.

In the invention it is preferable that a nip width between the developing roller and the supplying roller is 2.0 to 4.0 mm (2.0 mm or more and 4.0 mm or less)

According to the invention, provided is a non-magnetic single component developing device comprising a developing roller, a regulating blade, and a supplying roller containing a rubber foam at least in its surface layer portion, the rubber foam including closed cells and open cells and having a foam ratio (porosity) of 0.75 to 0.85 and an average foam cell diameter of 300 to 500 μm (preferably 350 to 500 μm).

The non-magnetic single component developing device of the invention can form high quality recorded images having, for example, very good consistency of solid images and uniformity of halftone images over a long time by using the supplying roller including the specific rubber foam.

The supplying roller used in the non-magnetic single component developing device of the invention is made of an open and closed cell rubber foam in which closed cells and open cells are both present at least in its surface layer portion, the rubber foam having the specific foam ratio and the specific average foam cell diameter (hereinafter, referred to as "rubber foam", unless otherwise specified), so that the supplying roller can carry a suitable amount of toner. In addition, ever if used for a long time and continuously, the amount of toner that remains in the foam cells does not increase to an amount that affects the surface hardness, and thus hardening is prevented. Therefore, there is substantially no occurrence of an increase of the driving torque, a reduction of performance of supplying toner to the developing roller, abrasion, toner degradation or the like involved in hardening, and the initial performance of the supplying roller can be maintained in high level. The rubber foam constituting the supplying roller has appropriate elasticity and mechanical strength, and also from this aspect, the increase of the driving torque is prevented, and the contact pressure with the developing roller becomes uniform. Furthermore, the supplying roller having a structure in which a circumferential surface of a core metal is coated with the rubber foam has the advantage that the rubber foam is not peeled off from the core metal even after a long term and continuous use. Thus, using the rubber foam, the durability of the supplying roller can be improved significantly and the life of the supplying roller can be achieved.

According to the invention, in the rubber foam, the pore diameter of an opening portion formed in the foam cell film between adjacent foam cells of the open cells is 300 μm or less, preferably 200 μm or less, so that penetration of toner into foam cells, and then hardening of the supplying roller is further prevented. Thus, the durability of the supplying roller can be further improved and the life of the supplying roller can be prolonged further.

Furthermore, according to the invention, as the rubber foam, a rubber foam that does not contain a plasticizer is preferable, and an ethylene propylene rubber (EPDM) foam that does not contain a plasticizer is particularly preferable. When such a rubber foam is used, deterioration of the characteristics such as elasticity and mechanical strength due to a friction and friction heat between the supplying roller and the developing roller is even smaller, so that an increase of the driving torque can be suppressed and a supplying roller whose driving torque is further stabilized can be obtained. The supplying roller has an excellent ability to scratch toner from the developing roller and an excellent ability to supply toner to the developing roller. In the invention, applying the open and closed cell rubber foam having the specific foam ratio and average foam cell diameter that is made of a rubber material that can foam without a plasticizer to the supplying roller, the above-described effects can be obtained.

According to the invention, the rubber foam has a density of 0.14 to 0.30 g/cm$^3$ (preferably 0.15 g/cm$^3$ to 0.25 g/cm$^3$) so that abrasion of the supplying roller, an increase of the driving torque of the supplying roller, toner filming onto the developing roller, toner degradation or the like can be further prevented. Furthermore, in the supplying roller having a structure in which the circumferential surface of the core metal is coated with the rubber foam, the rubber foam can be further prevented from being peeled off from the core metal.

Furthermore, according to the invention, the rubber foam has a tensile strength according to JIS K6251 of 0.2 MPa or more, so that in the supplying roller having a structure in which the circumferential surface of the core metal is coated with the rubber foam, the rubber foam can be further prevented from being peeled off, which increases the curability of the supplying roller. In particular, when the nip width between the developing roller and the supplying roller is set in the range from 2.0 to 4.0 in, this is preferable, and even in a long term use and/or continuous use, the rubber foam is not peeled off from the core metal, and thus a supplying roller having even better durability can be obtained.

Furthermore, according to the invention, the nip width (contact width) between the developing roller and the supplying roller is 2.0 to 4.0 mm, an appropriate amount of toner can be supplied to the developing roller. When the nip width is set in the specific range and the supplying roller has a structure in which the circumferential surface of the core metal is coated with the rubber foam, it is preferable to select the rubber foam so that the peeling strength of the rubber foam from the core metal is 100 gf or more. Thus, rupture, peeling-off, etc. of the rubber foam can be prevented.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
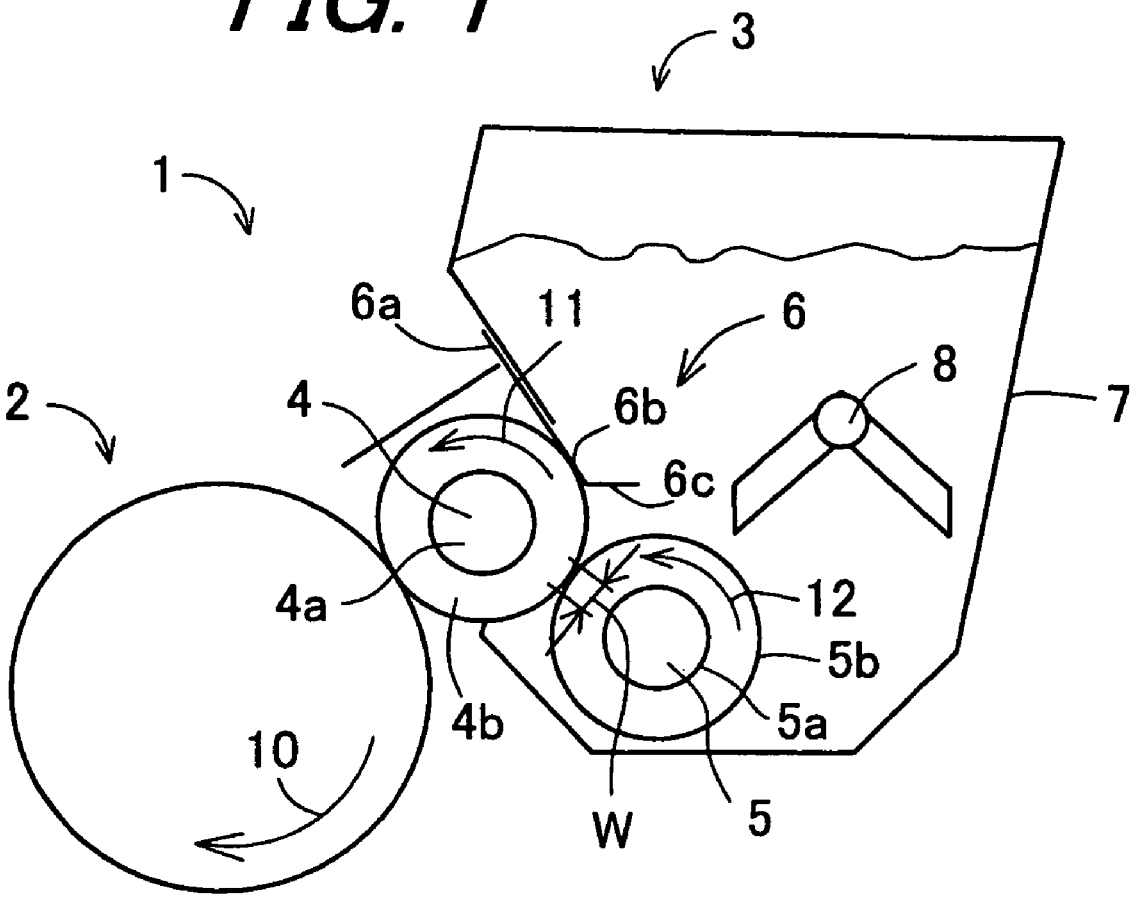
FIG. 1 is a side view schematically showing a configuration of a relevant portion of an image forming apparatus of an electro-photographic system.
Figure 2:
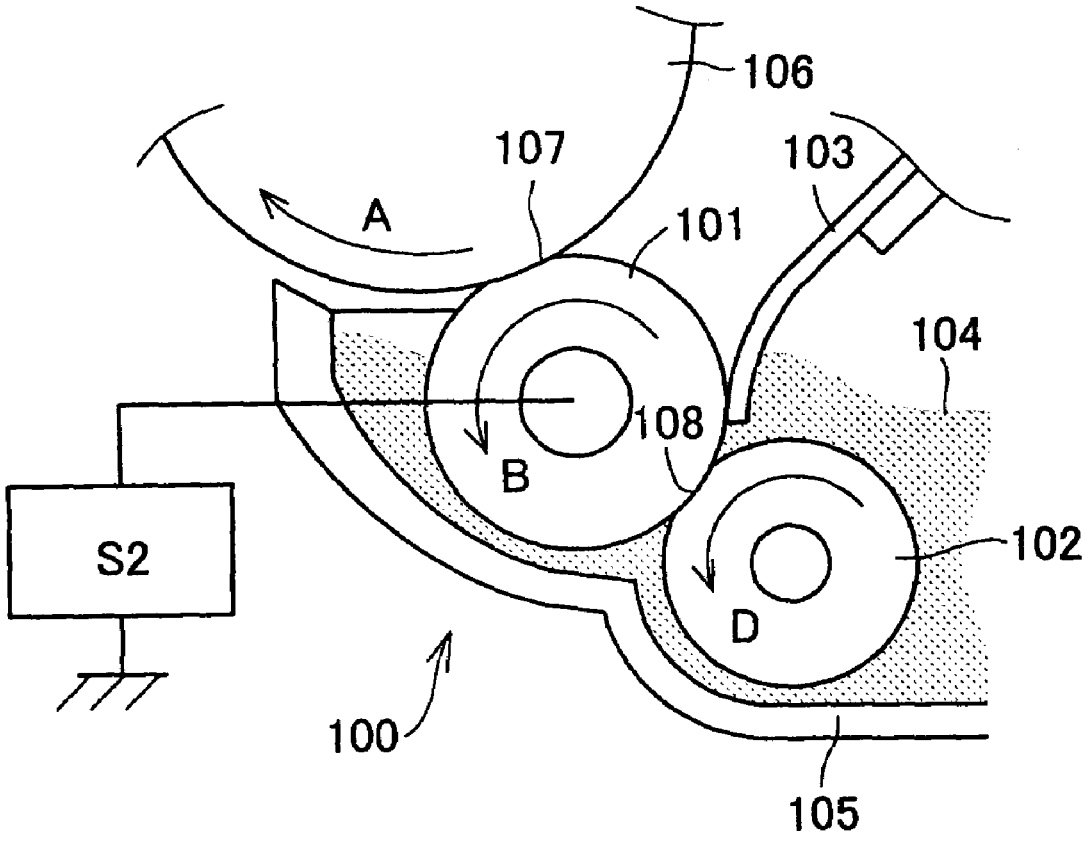
FIG. 2 PRIOR ART
FIG. 2 is a sectional view schematically showing a configuration of a conventional single component developing device.

Now referring to the drawings, preferred embodiments of the invention are described below.

FIG. 1 is a side view schematically showing the configuration of the relevant portion of an image forming apparatus 1 of the electro-photographic system including a non-magnetic single component developing device 3 according to a first embodiment of the invention. The image forming apparatus 1 includes a photoreceptor 2 that is supported so as to be rotatable in the direction of an arrow 10 and on the circumferential surface of which electrostatic latent images are formed, and a non-magnetic single component developing device 3, which is a first embodiment of the invention, that is opposed to the circumferential surface of the photoreceptor 2 and extends parallel to the direction to which the axis of the photoreceptor 2 extends.

A charging device (not shown), exposing means (not shown) the non-magnetic single component developing device 3, transferring means (not shown) and cleaning means (not shown) are provided around the photoreceptor 2 in this order from the upstream side to the downstream side in the rotation direction of the arrow 10, opposed to the circumferential surface of the photoreceptor 2.

For the photoreceptor 2, a conventional photoreceptor in which a photosensitive layer is formed on the surface of a conductive support can be used. For the conductive support, materials that are commonly used in the art can be used. For example, a drum and a sheet made of a metal such as aluminum, aluminum alloys, copper, zinc, stainless steel and titanium; and a drum, a sheet, and a seamless belt in which a conductive layer is formed on a substrate of synthetic resin such as polyethylene terephthalate, nylon and polystyrene, hard paper, glass, ceramics or the like can be used. For the conductive layer that is formed an the various substrates, any material that is commonly used in the art can be used. For example, a metal foil, a metal evaporated layer, a coating layer of a resin component containing a conductive material, an evaporated layer or a coating layer of conductive metal oxide such as tin oxide and indium oxide can be used. The surface of the conductive support can be subjected to, for example, an anodic oxidation coating treatment, a surface treatment with chemicals and hot water, a coloring treatment, or irregular reflection treatment such as a treatment for making the surface rough, if necessary, as long as the treatment does not adversely affect the image quality. The photosensitive layer may be a single layer type in which a charge-generating substance and a charge-transporting substance are contained in one layer, or may be a laminated layer type in which a charge-generating layer containing a charge-generating substance and a charge-transporting layer containing a charge-transporting substance are laminated. The photosensitive layer can further include, for example, an intermediate layer, an undercoat layer, and a protective layer. For a synthetic resin serving as a matrix of the charge-generating layer and the charge-transporting layer and other layers, any synthetic resin that is commonly used in the art can be used. The circumferential surface of the photoreceptor 2 is charged uniformly with monopolar electricity by a charger (not shown), and is irradiated with light based on image information by exposing means (not shown), and thus an electrostatic latent image is formed.

The non-magnetic single component developing device 3 according to a first embodiment of the invention includes a developing roller 4, a supplying roller 5, a doctor 6 a toner bath 7 and a stirring blade 8. The developing roller 4 supplies toner to the circumferential surface of the photoreceptor 2 to form an electrostatic latent mage to a toner mage. The supplying roller 5 supplies toner to the developing unit. The doctor 6 is a regulating blade for uniformalizing the thickness of the toner layer on the circumferential surface of the developing roller 4. The toner bath 7 contains toner. The stirring blade 8 is provided in the toner bath 7 and stirs the toner contained in the toner bath.

The non-magnetic single component developing device 3 further has a power source for development bias (not shown) for applying a voltage for development bias to the developing roller 4, a power source for toner supplying bias (not shown) for applying a bias voltage to the supplying roller 5, and a power source for doctor bias (not shown) for applying a bias voltage to the doctor 6.

The developing roller 4 is provided in such a manner that its circumferential surface is in contact with the circumferential surfaces of the photoreceptor 2 and the supplying roller 5 and supported so as to be rotatable in the direction of an arrow 11. The developing roller 4 includes a cylindrical core metal 4*a* made or a metal such as stainless steel and a conductive elastic layer 4*b* formed in a uniform thickness around the core metal 4*a* and is formed into a cylindrical shape. The conductive elastic layer 4*b* is a conductive rubber elastic member including rubber such as urethane rubber, silicon rubber, nitrile rubber, ethylene-propylene-diene copolymer-based synthetic rubber (EPDM) and natural rubber and a conductive material such as carbon black. Among these, conductive urethane elastic member is preferable. There is no particular limitation regarding the surface roughness (Rz) of the conductive elastic layer 4*b*, but a surface roughness of 5 to 25 μm is preferable. The surface roughness (Rz) is the ten point average roughness that is defined in JIS B 0601.

The developing roller 4 in which the conductive elastic layer 4*b* includes a conductive urethane rubber elastic member can be produced, for example, in the following manner. First, one part by weight of conductive carbon is added to 100 parts by weight of polyestercl (product name: Nipporan N-4032 manufactured by Nippon polyurethane Industry Co., Ltd.) and is uniformly dispersed, and then is heated to 140° C. and is subjected to dehydration and drying for 12 hours while being stirred under a reduced pressure of $1.33322\times10^3$ to $2.66644\times10^3$ Pa (10 to 20 mmHg). Then, 7 parts by weight of tolylenediisocyanate (product name: Colonate T-80 manufactured by Nippon Polyurethane Industry Co. Ltd.) is added to this mixture while heating at 110 to 120° C. and mixed intensely for 2 minutes. This mixture is heated to 110° C. and poured into a mold in which the core metal 4*a* is mounted in a predetermined position, and cured over 2 hours. The surface of the core metal 4*a* may be coated with an adhesive, necessary. Furthermore, when the second crosslinking is caused at 110° C. for 24 hours, a conductive urethane rubber-foam layer is formed on the surface of the core metal 4*a*. This foam layer is abraded so as to have a desired diameter and surface roughness, so that the conductive elastic layer 4*b* is formed and thus the developing roller 4 can be obtained.

The developing roller 4 is supplied with a voltage from the power source for development bias (nor shown), and thereby carries toner supplied from the supplying roller 5 in the form of a thin film on its circumferential surface. The thickness of this toner thin film is uniformalized by the doctor 6 as appropriate, and then the toner thin film brought into contact with a portion in which the electrostatic latent image is formed on the circumferential surface of the photoreceptor 2, so that the electrostatic latent image is developed to a toner image by the contact development method.

The supplying roller 5 includes a core metal 5*a* and an elastic layer 5*b* formed on the surface of the core metal 5*a*, is provided in such a manner that its circumferential surface is in contact with the circumferential surface of the developing roller 4 and is supported so as to be rotatable in the direction of an arrow 12. To the supplying roller 5, a bias voltage is applied from the power source for toner supplying bias (not shown), generally in the direction in which toner is pressed to the developing roller 4. When the toner has a negative polarity, a more negative bias voltage is supplied to the supplying roller 5.

For the core metal 5*a*, for example, a cylindrical molded member made of common steel, stainless steel, synthetic resin or the like can be used.

The elastic layer 5*b* contains a rubber foam including closed cells and open cells, each of which having a foam cell diameter of 100 to 800 μm, the rubber foam having a foam ratio (porosity) of 0.75 to 0.85 and an average foam cell diameter of 300 to 500 μm, preferably 350 to 500 μm.

The rubber foam that forms at least the surface layer portion of the supplying roller 5 is a rubber foam in which both closed cells and open cells are present inside. For this rubber foam, it is not sufficient that closed cells and open cells are simply present, but it is necessary that the foam ratio expressed by the porosity and the average diameter of the foam cells contained in the foam are in the specific ranges in order to obtain the advantages of the invention.

When the foam ratio is less than 0.75, the amount of toner carried by the supplying roller 5 is reduced, and further, the toner amount that can be supplied onto the developing roller 4 is reduced, so that the consistency of the toner in heavily printed images such as solid images deteriorates, and thus defective printing such as blur occurs. The surface hardness of the supplying roller 5 is increased, and she friction force with the developing roller 4 is increased, so that the driving torque is increased, and the toner filming onto the developing roller 4, toner degradation, abrasion of the supplying roller 5 tend to occur. On the other hand, when the foam ratio exceeds 0.85, the surface hardness of the supplying roller 5 is reduced, so that the ability to scratch toner on the developing roller 4 is insufficient, and toner is supplied to the photoreceptor 2 in an excess amount. Therefore, positive fog in which toner is attached to a non-printing portion on the photoreceptor 2 occurs, and the amount of toner consumed is increased. Furthermore, since the amount of toner carried by the supplying roller 5 is increased, the supplying roller 5 becomes hard as the driving time passes. In addition, the mechanical strength of the rubber foam is decreased, which makes the contact with the developing roller 4 non-uniform. Therefore, in the supplying roller that is configured such that the circumferential surface of a core metal is coated with a rubber foam, the rubber foam may be peeled off during continuous use.

When the average foam cell diameter is less than 300 μm, the amount of toner carried by the supplying roller 5, that is, the amount of toner that can be supplied onto the developing roller 4 is reduced, so that defective printing occurs due to deterioration of the consistency of solid images. Furthermore, an increase of the driving torque occurs due to a reduction of the elasticity of the supplying roller 5. When the average foam cell diameter exceeds 500 μm, the amount of toner supplied to the developing roller 4 becomes unstable, and the uniformity of halftone images or the like deteriorates. In addition, the ability to scratch toner on the developing roller 4 is decreased, so that defective images, for example, a fog due to non-uniformity of toner charging occurs. Furthermore, a reduction in the mechanical strength of the rubber foam increases the abrasion amount of the supplying roller 5.

In the rubber foam, it is desirable that a pore diameter of an opening portion (communication hole) formed in the foam cell film between adjacent foam cells of the open cells is 300 μm or less, preferably 200 μm or less, more preferably 10 to 200 μm. Using such a rubber foam, the life of the supplying roller 5 can be prolonged. When the pore diameter significantly exceeds 300 μm, the amount of the toner that remains increases during continuous use, so that the surface hardness of the supplying roller 5 may be increased.

There is no particular limitation regarding the density of the rubber foam, but the density is preferably 0.14 to 0.30 g/cm$^3$, more preferably 0.15 to 0.25 g/cm$^3$. When the density is significantly smaller than 0.14 g/cm$^3$, the surface hardness of the rubber foam is decreased. Consequently, the ability to scratch the toner on the developing roller 4 is decreased, so that the amount of toner supplied to the developing roller 4 may become unstable. Furthermore, the mechanical strength of the rubber foam is decreased, and the abrasion may become significant. In the supplying roller that is configured such that a core metal is coated with a rubber foam, the rubber foam may be peeled off. When the density significantly exceeds 0.30, the surface hardness of the supplying roller is increased, and accordingly, for example, an increase of the driving torque, toner filming onto the developing roller 4, toner degradation, and abrasion of the supplying roller 5 tend to occur. Furthermore, a reduction of the amount of toner supplied to the developing roller 4 may occur. The density can be controlled by the temperature during rubber vulcanization. Even if the density is reduced, there is no problem such as exudation of a low molecular weight component.

Furthermore, it is preferable that the rubber foam has a tensile strength defined in JIS K6251 of 0.2 MPa or more, more preferably 0.2 to 0.5 MPa. When the tensile strength is less than 0.2 MPa, in particular, when the nip width between the developing roller 4 and the supplying roller 5 is set in the range from 2.0 to 4.0 mm, the rubber foam may be peeled off and the durability of the supplying roller 5 may be lowered.

In the rubber foam used in the invention, there is no limitation regarding the ratio between the open cells and the closed cells, and it is sufficient that the open cells and the closed cells can be visually observed when the section of the rubber foam is observed through a scanning electron microscope. However, the continuous foam cell ratio, which is the ratio of the open cells, is preferably 5% or more, more preferably 10% or more, particularly preferably 10 to 60%.

In this specification, the foam ratio (porosity ratio) the average foam cell diameter, the core diameter of the opening portion of the foam cell film and the continuous foam cell ratio (%) can be obtained in the following manner.

[Foam Ratio (Porosity Ratio)]

A rubber foam having a volume V (mm$^3$) was sunk under the water surface of a water bath having an inner dimension of 1000 mm×1000 mm, and a height h (mm) by which the water surface was raised at that time was measured, and the foam ratio was obtained according to the following equation:

$$\text{roam ratio } (\%)=[(V-1000\times1000\times h)/V]\times100\%$$

[Average Foam Cell Diameter]

The average foam cell diameter is obtained as follows. Enlarged photographs of sections in the extrusion direction (MD direction) of the rubber foam and the direction orthogonal thereto (TD direction), and the thickness direction (VD direction) that is orthogonal to both of the directions are taken with a microscope. In these photographs, the number of foam cells on one line (length L) is counted, and the average foam cell diameter is obtained based on the length L and the number of the foam cells

[Pore Diameter of the Opening Portion Foam Cell Walls]

The pore diameter is obtained by observing the section of the rubber foam through a microscope.

The rubber foam used in the supplying roller 5 can be produced by mixing components of a rubber composition for foaming containing a synthetic rubber, a softening agent, a filler, an organic foaming agent, a vulcanizing agent and the like, as appropriate, such that the foam ratio 0.1 to 0.8, preferably 0.2 to 0.6, foaming the composition by an ordinary method, and pressing the obtained foam. The foam ratio herein is not the foam ratio as the porosity, but a value obtained by dividing the density of the rubber foam after vulcanization and foaming by the density of unvulcanized rubber. For example, the amounts of the components are as follows: with respect to 100 parts by weight of a synthetic rubber, 10 to 200 parts by weight (preferably, 60 to 150 parts by weight) of a softening agent; 5 to 300 parts by weight of a filler; 1 to 50 parts by weight (preferably, 10 to 40 parts by weight) of an organic foaming agent; and 0.01 to 10 parts by weight (preferably, 1 to 3 parts by weight) of a vulcanizing agent can be used.

There is no limitation regarding the rubber, and any known rubber can be used, but synthetic rubber that can be foamed without a cross linking agent and can provide a foam having good mechanical strength. Specific examples thereof include ethylene propylene rubber (ethylene-propylene-diene copolymer based synthetic rubber, EPDM), chloropropylene, nitrile rubber, butadiene rubber, styrene-butadiene rubber, nitrile-butadiene rubber, isopropylene rubber, and isobutylene-isopropylene rubber. Among these, ethylene propylene rubber is preferable, because minute and uniform foam cells that are comparable to urethane rubber foam can be easily formed, the density of the obtained foam can be controlled easily by the temperature control during vulcanization and foaming, a reduction of the elasticity is small even with a long term use and an effect of stabilizing the driving torque of the supplying roller 5 is large, and the ability to scratch the toner on the developing roller 4 and the ability to supply toner to the developing roller 4 are maintained in high level for a long time. These can be used alone or in combination of two or more, if necessary.

As the softening agent, known softening agents can be used, and for example, dibutylphthalate, dibutylphthalate, polyester plasticizers, spindle oil, machine oil, cylinder oil, paraffin process oil, naphthenic process oil, liquid paraffin, Vaseline, coal tar, coal tar pitch, castor nil, cotton seed oil, beeswax, lanoline, resins that are liquid or solid at room temperature, and polybutene can be used. As the softening agent, these can be used alone or in combination of two or more.

As the filler, any known fillers can be used. For example, inorganic fillers such as calcium carbonate, talc, clay, asbestos, pumice flow, glass fibers, mica, silica, carbon black and hollow beads, and organic fillers such as reclaimed rubber, shellac, wood flour and cork flour can be used. As the filler, these can be used alone or in combination of two or more.

As the organic foaming agent, any known organic foaming agents can be used. For example, nitroso compounds such as N,N'-dinitrosopentamethylenetetramine and N,N'-dimethyl-N,N'-dinitrosoterephthalamide, azo compounds such as azodicarbosoamide, azobisisobutylnitrile and diazoaminobenzene, sulfonyl hydrazide compounds such as benzenesulfonyl hydrazide and toluenesulfonyl hydrazide, p-toluenesulfonyl azide, and 4,4'-oxybis benzososulfonyl hydrazide can be used. As the organic foaming agent, these can be used alone or in combination of two or more.

As the vulcanizing agent, any known vulcanizing agents can be used. For example, sulfur, sulfur sulfide, sulfur dioxide, p-quinone dioxime, hexa diamine carbamate, ethylenediamine carbamate can be used. As the vulcanizing agent, these can be used alone or in combination of two or more.

The rubber composition for foaming may contain, if necessary, a vulcanization accelerator such as diphenylguanidine, triphenylguanidine, 2-mercaptobenzothiazol, dibenzothiazol disulfide, thiocarbanilide, diethylthiourea, tetramethylthiuram monosulfide, tetramethylthiuram disulfide, zinc dimethyldithiocarbamate and sodium dimethyldithiocarbamate, a vulcanization accelerator auxiliary such as zinc oxide, magnesium oxide, stearic acid, oleic acid and cyclohexylamines, dicyclohexylamines, an antioxidant such as phenol compounds, amine ketone compounds and aromatic amine compounds, a foaming auxiliary such as salicylic acid and urea. As additives, these can be used alone or an combination of two or more.

A specific example of the rubber composition or foaming is as follows: 100 parts by weight of ethylene propylene polymer/5 parts by weight of zinc oxide/3 parts by weight of stearic aced/10 parts by weight of carbon black/40 parts by weight of paraffin process oil/1.5 parts by weight of sulfur/2 parts by weight of butylthiourea/20 parts by weight of azodicarboxylic acid amide/14 parts by weight of a foaming auxiliary (product name: CELLPASTE K-5 manufactured by EIWA Chemical Ind. Co.)

The supplying roller 5 can be produced by a known method. For example, the components (including carbon black) of the rubber compound for foaming are kneaded with a commonly used kneader for rubber kneading and a roller so that an unvulcanized rubber composition for foaming can be obtained. This is extruded and molded into a tubular shape by an extruder, and this tube is heated by a hot air vulcanizer continuously, so that foaming and vulcanization proceeds and thus a conductive foam tube can be obtained. The conductive foam tube is cut to a predetermined length. A core metal whose circumferential surface is coated with an additive is pressed into the tube, and the tube and the core metal are attached. Furthermore, the member including the rubber foam and the core metal that are attached to each other is subjected to an abrading process, and the diameter, the surface roughness and the like are adjusted to desired values. Thus, the supplying roller 5 having a structure in which a coating layer including the rubber foam is formed on the circumferential surface of the core metal can be obtained.

As an apparatus for vulcanizing and foaming the unvulcanized rubber composition for foaming, a UHF continuous vulcanizing apparatus is preferable. In this apparatus, vulcanization and foaming are performed, for example, at an UHF power of 0.1 to 1.5 kw, a temperature of the UHF bath of 200 to 240° C., and a temperature of the HAV bath of 200 to 230° C., and preferably a pressurizing operation is performed. Thus, a tubular shaped rubber foam having the foam ratio (porosity) and the average foam cell diameter as described above in which open cells and closed cells are both present can be obtained. It should be noted that when a UHF continuous vulcanizing apparatus is used, a rubber foam for use in the invention may be obtained without performing a pressurizing operation after vulcanization and foaming.

The supplying roller 5 rotates in the direction of the arrow 12 while being in contact with the developing roller 4, carries toner contained in the toner bath 7 on its circumferential surface, and then supplies the toner to the developing roller 4. Furthermore, the supplying roller scratches the remaining toner from the developing roller 4 after the toner is supplied to the electrostatic latent image on the circumferential surface of the photoreceptor 2, and supplies new toner to the circumferential surface of the developing roller 4 at the same time.

The developing roller 4 and the supplying roller 5 rotate in the arrows 11 and 12, respectively, and are in contact with each other, opposed in the opposite rotation directions in a portion (nip portion) in which these rollers are pressed against each other in contact. At this time, there is no particular limitation regarding the nip width W, but the nip width W is preferably 2.0 to 4.0 mm. When the nip width W is significantly less than 2.0 mm, the ability of the supplying roller 5 to scratch the remaining toner from the developing roller after the toner is supplied to the photoreceptor 2 is decreased, and toner is supplied onto the developing roller 4 in an amount that cannot be regulated by the doctor 6, so that defective images tend to occur. More specifically, ghosting may occur with the rotation cycle of the developing roller 4. Furthermore, an underlying fog in which toner is attached in a non-printing area of the photoreceptor 2 occurs, and the amount of toner consumed is increased. On the other hand, when the nip width significantly exceeds 4.0 mm, the friction force between the developing roller 4 and the supplying roller 5 is increased, and accordingly the driving torque is increased, and toner filming onto the circumferential surface of the developing roller 4, toner degradation, abrasion of the supplying roller 5 and the like may occur. In addition, defective images such as images with lines (non-uniform density) tend to be generated in the rotation cycles of the developing roller 4 and the supplying roller 5. In the supplying roller having a structure in which the core metal is coated with the rubber foam, when the nip width W is 2.0 to 4.0 mm, the tensile strength of the rubber foam is preferably 0.2 MPa or more. With this, the rubber foam is prevented from being peeled during long term or continuous use.

The doctor 6 includes a fixed end 6*a* that is fixed to the toner bath 7, a front end portion 6*c* that slightly inclines to the direction that is away from the developing roller 4, and a contact portion 6*b* positioned between the fixed end 6*a* and the front end portion 6*c* and provided so as to be in contact with the circumferential surface of the developing roller 4 by elastic deformation. To the doctor 6, a predetermined bias voltage is applied from the power source for doctor bias (not shown). More specifically, a bias voltage is applied in the direction to which toner is pressed from the doctor 6 to the developing roller 4 side. When the toner has a negative polarity, a more negative bias voltage than that to toner is applied to the doctor 6.

The contact portion 6*b* is made of an elastically deformable material at least whose surface opposing the circumferential surface of the developing roller 4 has a spring elasticity, and the contact portion 6*b* opposing the circumferential surface of the developing roller 4 near the front end portion 6*c* is in contact with the circumferential surface of the developing roller 4 along its longitudinal direction (the direction of the rotation axis of the developing roller 4) by a predetermined pressure.

The doctor 6 is a plate-like member constituted by a metal plate made of stainless steel, and the thickness is, for example, 0.07 to 0.15 mm. The front end portion 6*c* can be formed by subjecting a metal plate to mechanical processes such as cutting, polishing, and bending. Furthermore, the doctor can be formed by a method of attaching a chip-like front end portion that previously has been formed into a desired shape to a metal plate with, for example, a conductive adhesive, a method of providing the front end of a metal plate with a step and attaching a metal foil thereon with, for example, a conductive adhesive or other processing methods.

The doctor 6 is in contact (by pressure) with the circumferential surface of the developing roller 4 in the downstream side from the contact surface between the developing roller 4 and the supplying roller 5 in the direction of the arrow 11, and uniformalizes the thickness of the toner thin film that is carried by the circumferential surface of the developing roller 4. The toner thin film whose thickness has been uniformalized is conveyed to the development area in which the developing roller 4 is in contact with the photoreceptor 2.

The toner bath 7 contains toner Examples of a material constituting the toner bath 7 include synthetic resin such as polypropylene, polyethylene and polystyrene, and metal such as stainless steel and aluminum.

The stirring blade 8 is provided in the toner bath 7, and is supported rotatably. The stirring blade 9 stirs the toner contained in the toner bath to let the toner supply to the supplying roller 5 proceed smoothly, and also serves to prevent solidification of the toner due to deposition There is no particular limitation regarding the toner used in the non-magnetic single component developing device 3 of the invention, and conventional non-magnetic single component toners can be used. The non-magnetic single component toner is obtained by adding and mixing a general external additive such as silica, as appropriate, to toner particles, and removing aggregates and foreign matters therefrom. The toner-particles can be obtained by, for example, preliminarily mixing a binding resin (fixing resin), a coloring agent and an additive uniformly by a dry blender, a super mixer, a ball mill or the like; melting and kneading the obtained mixture uniformly by a kneading apparatus such as a hand mixer, a roll, a single screw kneading extruder and a twin screw kneading extruder; cooling and pulverizing the obtained kneaded product; and if necessary classifying the resultant product. As the binding resin, the coloring agent, and the additive, any materials that are commonly used in the art can be used.

In the non-magnetic single component developing device 3 of the invention, the toner contained in the toner bath 7 is supplied to the developing roller 4 via the supplying roller 5. The thickness of the toner attached onto the circumferential surface of the developing roller 4 is uniformalized by the doctor 6, and thus a toner thin layer is formed. The toner thin layer is supplied to the electrostatic latent image formed on the circumferential surface of the photoreceptor 2, and the latent image is thereby developed, so that a toner image is formed. It is believed that the mechanism by which the supplying roller 5 supplies the toner to the developing roller 4 in the nonmagnetic single component developing device 3 of the invention is attributed to the fact that the toner is charged by the friction with the developing roller 4 and therefore is attached to the developing roller 4.

EXAMPLES

Hereinafter, the invention will be described by way of examples and comparative examples.

Examples 1 to 3 and Comparative Examples 1 to 5

In a full color copier (product name: AR-C260 manufactured by SHARP CORPORATION) in which a non-magnetic single component developing device is mounted, using rollers in which a core metal (shaft, diameter: 8 mm, length: 360 mm) made of stainless steel is coated with continuous and signal all type rubber elastic layers made of the rubber foams shown in Table 1 having a thickness 2.7 mm as the supplying roller, non-magnetic single component developing devices of the invention and those for comparison were produced. In this copier, the nip width between the developing roller and the supplying roller was 2.5 mm.

TABLE 1

| | | Material | Average foam cell diameter μm | Foam ratio | Pore diameter of foam cell wall μm | Density g/cm$^3$ | Tensile Strength MPa |
|---|---|---|---|---|---|---|---|
| Ex. | 1 | EPDM | 450 | 0.80 | 100 or less | 0.19 | 0.245 |
| | 2 | EPDM | 450 | 0.75 | 100 or less | 0.23 | 0.358 |
| | 3 | EPDM | 450 | 0.85 | 100 or less | 0.17 | 0.213 |
| Com. | 1 | EPDM | 450 | 0.70 | 100 or less | 0.27 | 0.396 |
| Ex. | 2 | EPDM | 450 | 0.90 | 100 or less | 0.15 | 0.166 |
| | 3 | EPDM | 300 | 0.70 | 100 or less | 0.32 | 0.488 |
| | 4 | EPDM | 600 | 0.90 | 100 or less | 0.13 | 0.142 |
| | 5 | EPDM | 450 | 0.80 | 200–500 | 0.18 | 0.158 |

Using this full color copier, A3 solid images were printed on 10000 paper sheets at room temperature and regular humidity, and the following tests were performed before and after the printing. Table 2 shows the results.

[Driving Torque]

The non-magnetic single component developing devices of the examples and the comparative examples were attached to a speed control unit (product name: SPEED CONTROL UNIT manufactured by ORIENTAL MOTOR Co. Ltd.) that had been modified so as to drive these developing devices, and then the driving torque was measured. The circumferential speed ratio between the developing roller and the supplying roller during measurement was set to 0.5. In order to prevent abrasion due to sliding contact between the supplying roller and the developing roller, the driving torque is required to be about 0.294 Nm (3.0 kgf/cm) or less.

[HT Uniformity]

Halftone images (HT image) were recorded before and after actual or printing of 10000 sheets, and were evaluated by visual observation. When the image after actual printing of 10000 sheets is not changed from the initial image, and a satisfactory halftone image without lines or roughness is obtained, this is defined as having a high HT uniformity. Having a high HT uniformity means that abrasion of the supplying roller or non-uniformity of the contact pressure of the supplying roller against the developing roller due to the fact that toner penetrates the vicinity of the shaft of the supplying roller and remains there does not occur.

[Consistency of Solid Images]

The density of the printed front end portion and the printed rear end portion of a A3 black solid image was measured with an image density measuring device (product name: X-rite, manufactured by X-rite), and the consistency of solid images is indicated by the value obtained by subtracting the density of the printed rear end portion from the density of the printed front portion. Unless the consistency of solid images is 0.15 or less, defective printing such as blur occurs.

[Surface Hardness]

The surface hardness of the supplying roller was measured with an ASKER FP spring type hardness meter (manufactured by KOBUNSHI KEIKI CO. LTD) in the following manner. The supplying roller is fixed on a horizontal surface so as not to move, and the ASKER FP spring type hardness meter was placed on the central portion of the supplying roller and the value at that time was taken as the surface hardness value of the supplying roller. It is preferable that the surface hardness of the supplying roller is 90° or less. When it exceeds 90°, the driving torque is increased.

Table 1 evidently shows the following. In Comparative Example 1, the driving torque is as high as about 0.304 to about 0.333 N·m and the consistency of solid images is low from the beginning. In Comparative Examples 2 and 4, although the driving torque is low, vertical lines are generated in halftone images. In Comparative Example 3, the driving torque is as high as about 0.324 to about 0.353 N·m and the consistency of solid images is 0.23 at the beginning and 0.28 after printing of 10000 sheets. The reason why the consistency of solid images is low in Comparative Examples 1 and 3 seems to be that the foam ratio of the supplying roller is small, so that the ability to carry toner, and further, the ability to supply toner is lows. In Comparative Example 5, the pore diameter of some communication bores of the foam cell walls exceeds 300 μm, so that the surface hardness of the supplying roller becomes relatively high at the printing of around 10000 sheets. In particular, the ASKER hardness is as high as 97° after the printing, and thus the supplying roller becomes very hard. Consequently, the supplying roller is worn away and is not uniformly in contact with the developing roller, so that the halftone images become non-uniform and rough. The supplying roller becomes hard, presumably because the toner penetrates into the central portion of the shaft of the supplying roller as the driving time passes, and the toner remains there.

On the other hand, in Examples 1 to 3, the surface hardness and the driving torque of the supplying roller are not increased, and the HT uniformity and the consistency of solid images are significantly good.

TABLE 2

| | | Driving torque N · m (kgf · cm) | HT uniformity before | HT uniformity after | solid image consistency before | solid image consistency after | ASKER hardness(°) before | ASKER hardness(°) after |
|---|---|---|---|---|---|---|---|---|
| Ex. | 1 | About 0.235–0.255 (2.4–2.6) | good | good | 0.08 | 0.10 | 83 | 82 |
| | 2 | About 0.255–0.284 (2.6–2.9) | good | good | 0.14 | 0.14 | 85 | 85 |
| | 3 | About 0.226–0.245 (2.3–2.5) | good | good | 0.07 | 0.09 | 80 | 82 |
| Com. Ex. | 1 | About 0.304–0.333 (3.1–3.4) | good | good | 0.17 | 0.19 | 90 | 91 |
| | 2 | About 0.216–0.245 (2.2–2.5) | vertical line | vertical line | 0.08 | 0.14 | 79 | 81 |
| | 3 | About 0.324–0.353 (3.3–3.6) | good | good | 0.23 | 0.28 | 96 | 95 |
| | 4 | About 0.245–0.255 (2.2–2.6) | vertical line | vertical line | 0.05 | 0.10 | 92 | 83 |
| | 5 | About 0.235–0.255 (2.4–2.6) | good | note 1 | 0.08 | 0.15 | 90 | 97 |

Note 1:
Occurrence of roughness (halftone images look non-uniform and rough due to fine lightness and darkness)

Example 4

A single component developing device of the invention was obtained by adjusting the nip width between the supplying roller and the developing roller of the supplying roller of Example 1 to 3.0 mm. The tensile strength of the rubber foam of Example 1 is 0.245 MPa.

This developing device was mounted in a full color copier (AR-C260), actual printing of 10000 sheets was performed at a printing ratio of 5%. Then, the driving torque was 2.2 to 2.8 kgf/cm, the consistency of solid images is 0.15 or less, which are both good. The peeling of the rubber foam was not observed.

Comparative Example 6

A single component developing device of the invention was obtained by adjusting the nip width between the supplying roller and the developing roller of the supplying roller of Comparative Example 4 to 3.0 mm. The tensile strength of the rubber foam of Comparative Example 4 is 0.142 MPa.

This developing device was mounted in a full color copier (AR-C260), actual printing of 10000 sheets was performed at a printing ratio of 5%. In the mid-process, the rubber foam was partially peeled. Consequently, the supply of toner to the developing roller is non-uniform, and defective printing such as lines and non-uniformity in the density occurred.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A non-magnetic single component developing device comprising:

a developing roller that is in contact with a surface of a photoreceptor and supplies toner to an electrostatic latent image on the surface of the photoreceptor;

a regulating blade that is in contact with a circumferential surface of the developing roller and forms a toner thin film on the circumferential surface of the developing roller; and a supplying roller that is in contact with the circumferential surface of the developing roller and supplies toner to the circumferential surface of the developing roller, in which the toner formed into a thin film by the regulating blade in the circumferential surface of the developing roller is supplied to the surface of the photoreceptor that is in contact with the circumferential surface of the developing roller to turn the electrostatic latent image into a toner image, wherein the supplying roller contains a rubber foam at least in its surface layer portion, the rubber foam including closed cells and open cells and having a foam ratio (porosity) of 0.75 to 0.85 and an average foam cell diameter of 300 to 500 μm.

2. The non-magnetic single component developing device of claim 1, wherein in the rubber foam, the pore diameter of an opening portion formed in the foam cell film between adjacent foam cells of the open cells is 300 μm or less.

3. The non-magnetic single component developing device of claim 2, wherein the pore diameter of the opening portion is 200 μm or less.

4. The non-magnetic single component developing device of claim 1 wherein the rubber foam does not contain a plasticizer.

5. The non-magnetic single component developing device of claim 1, wherein the rubber foam is an ethylene propylene rubber foam that does not contain a plasticizer.

6. The non-magnetic single component developing device of claim 1, wherein the rubber foam has a density of 0.14 to 0.30 $g/cm^3$.

7. The non-magnetic single component developing device of claim 1, wherein the rubber foam has a tensile strength of 0.2 MPa or more.

8. The non-magnetic single component developing device of claim 1, wherein a nip width between the developing roller and the supplying roller is 2.0 to 4.0 mm.

9. The non-magnetic single component developing device of any one of claims 1–8, wherein the rubber foam can be foamed without a crosslinking agent.

* * * * *